US010486291B2

(12) United States Patent
Bartoszek

(10) Patent No.: US 10,486,291 B2
(45) Date of Patent: Nov. 26, 2019

(54) INTEGRAL TOOL HOUSING HEAT SINK FOR LIGHT EMITTING DIODE APPARATUS

(71) Applicant: Ingersoll-Rand Company, Davidson, NC (US)

(72) Inventor: Jason Christopher Bartoszek, Annandale, NJ (US)

(73) Assignee: Ingersoll-Rand Company, Davidson, NC (US)

( * ) Notice: Subject to any disclaimer, the term of this patent is extended or adjusted under 35 U.S.C. 154(b) by 32 days.

(21) Appl. No.: 14/539,093

(22) Filed: Nov. 12, 2014

(65) Prior Publication Data

US 2016/0131353 A1 May 12, 2016

(51) Int. Cl.

| | |
|---|---|
| ***F21V 19/00*** | (2006.01) |
| ***F21V 29/70*** | (2015.01) |
| ***B25B 23/18*** | (2006.01) |
| ***B25B 21/02*** | (2006.01) |
| ***B25F 5/00*** | (2006.01) |
| ***B25F 5/02*** | (2006.01) |
| *F21V 33/00* | (2006.01) |

(52) U.S. Cl.

CPC ..... *B25B 23/18* (2013.01); *B25B 21/026* (2013.01); *B25F 5/008* (2013.01); *B25F 5/021* (2013.01); *F21V 33/0084* (2013.01)

(58) Field of Classification Search

CPC ... F21V 19/001; F21V 33/0084; B25B 23/18; B25B 21/026

USPC ..... 362/119, 120, 577, 578, 194

See application file for complete search history.

(56) References Cited

U.S. PATENT DOCUMENTS 2,310,166 A * 2/1943 Way ..... B25F 5/021 310/50
2,525,588 A * 10/1950 Cameron ..... B23Q 17/2404 307/157
4,078,869 A * 3/1978 Honeycutt ..... B25F 5/021 33/286

(Continued)

FOREIGN PATENT DOCUMENTS

CN 101112757 A 1/2008
CN 101165396 A 4/2008

(Continued)

OTHER PUBLICATIONS

Office Action dated Sep. 21, 2011 from U.S. Appl. No. 12/145,824, filed Apr. 16, 2013.

(Continued)

*Primary Examiner* — Anh T Mai
*Assistant Examiner* — Arman B Fallahkhair
(74) *Attorney, Agent, or Firm* — Jones IP Group; Wayne A. Jones

(57) ABSTRACT

A power tool having a light source is provided. The power tool includes a light emitting diode and a thermally conductive housing that houses a movable component of the power tool, the thermally conductive housing including an integral portion that extends from the thermally conductive housing and is configured for thermally coupling with the light emitting diode. The integral portion of the thermally conductive housing is a heat sink for the heat generated by the light emitting diode, when the light emitting diode is thermally coupled to the integral portion of the thermally conductive housing.

11 Claims, 8 Drawing Sheets

(56) References Cited

U.S. PATENT DOCUMENTS

| | | | | |
|---|---|---|---|---|
| 5,158,354 | A * | 10/1992 | Simonin | B25B 21/00 173/164 |
| 6,725,945 | B2 | 4/2004 | Sugimoto et al. | |
| 6,915,727 | B2 | 7/2005 | Caluori | |
| 7,498,526 | B2 | 3/2009 | Lohr et al. | |
| 7,550,934 | B1 | 6/2009 | Deng et al. | |
| 7,568,288 | B2 | 8/2009 | Baker | |
| 7,677,752 | B2 * | 3/2010 | Tadokoro | B25B 23/18 362/119 |
| 7,800,119 | B2 * | 9/2010 | He | F21V 19/0015 257/100 |
| 8,016,048 | B2 | 9/2011 | Ueda et al. | |
| 8,210,715 | B2 * | 7/2012 | Mostoller | F21V 19/001 362/249.02 |
| 8,328,381 | B2 | 12/2012 | Dixon et al. | |
| 8,382,308 | B2 | 2/2013 | Hecht et al. | |
| 8,418,778 | B2 * | 4/2013 | Eshleman | B25B 21/00 173/1 |
| 8,421,375 | B2 | 4/2013 | Madineni et al. | |
| 8,714,765 | B2 | 5/2014 | Miyazawa | |
| 8,960,989 | B2 * | 2/2015 | Van De Ven | H05B 33/0803 362/459 |
| 9,028,088 | B2 * | 5/2015 | Vanko | B25F 5/021 362/119 |
| 9,328,915 | B2 * | 5/2016 | Vanko | F21V 33/0084 |
| 2005/0276053 | A1 | 12/2005 | Nortrup et al. | |
| 2006/0043911 | A1 | 3/2006 | Shao et al. | |
| 2006/0262519 | A1 | 11/2006 | Hirschburger et al. | |
| 2007/0086196 | A1 | 4/2007 | Wong | |
| 2008/0266840 | A1 * | 10/2008 | Nordmeyer | A61B 90/36 362/119 |
| 2008/0031016 | A1 | 12/2008 | Thomas et al. | |
| 2008/0310162 | A1 | 12/2008 | Thomas et al. | |
| 2009/0268107 | A1 | 10/2009 | Shimizu | |
| 2012/0033429 | A1 | 2/2012 | Van De Ven | |
| 2012/0133205 | A1 | 5/2012 | Adams et al. | |
| 2013/0000934 | A1 | 1/2013 | Todokoro et al. | |
| 2013/0021783 | A1 | 1/2013 | Vanko et al. | |
| 2013/0342050 | A1 | 12/2013 | Duesing et al. | |
| 2014/0036482 | A1 | 2/2014 | Vanko et al. | |

FOREIGN PATENT DOCUMENTS

| | | | |
|---|---|---|---|
| CN | 102753782 | A | 10/2012 |
| DE | 102005021383 | A1 | 11/2006 |
| EP | 1882553 | B1 | 9/2011 |

OTHER PUBLICATIONS

Office Action dated Apr. 30, 2012 from U.S. Appl. No. 12/145,824, filed Apr. 16, 2013.

Notice of Allowance dated Feb. 1, 2013 from U.S. Appl. No. 12/145,824, filed Apr. 16, 2013.

Office Action dated Jun. 21, 2013 from U.S. Appl. No. 13/764,885, filed Feb. 12, 2013.

Office Action dated Jan. 10, 2014 from U.S. Appl. No. 13/764,885, filed Feb. 12, 2013.

Advisory Action dated Mar. 14, 2014 from U.S. Appl. No. 13/764,885, filed Feb. 12, 2013.

Office Action dated Feb. 9, 2017 from U.S. Appl. No. 13/764,885, filed Feb. 12, 2013.

Office Action dated Sep. 22, 2017 from U.S. Appl. No. 13/764,885, filed Feb. 12, 2013.

Office Action dated Apr. 4, 2018 from Chinese Patent Application No. 201510762293.1, filed Nov. 10, 2015.

Office Action dated Dec. 18, 2017 from U.S. Appl. No. 13/764,885, filed Feb. 12, 2013.

* cited by examiner

INTEGRAL TOOL HOUSING HEAT SINK FOR LIGHT EMITTING DIODE APPARATUS

BACKGROUND

Advances in battery technology have fostered an ever increasing use of battery operated tools. Such advances allow the battery-powered tool to provide suitable power and functionality over increasingly longer periods of time and operate in varied places and conditions, which sometimes require the use of light. The need for energy-efficient bright light coupled with the advent of Light Emitting Diode (LED) technology has spawned an increasing development of tools having illumination capability.

Common cordless battery powered tools that provide flashlight-like illumination capability often utilize LEDs. Heat produced by the LED may reduce the life of the LED or cause the LED to go into thermal runaway and become inoperable. Thus, cordless battery powered tools that utilize LEDs may be presented with heat dissipation challenges.

SUMMARY

A described aspect provides a power tool comprising: a light emitting diode; and a metallic housing that houses a movable component of the power tool, the metallic housing including an integral portion thereof configured for thermally coupling with the light emitting diode; wherein the integral portion of the metallic housing is a heat sink for the heat generated by the light emitting diode, when the light emitting diode is thermally coupled to the integral portion of the metallic housing.

Another described aspect provides a power tool comprising: a light emitting diode; and a housing having a thermally conductive portion; wherein the thermally conductive portion of the housing includes a protruding heat sink portion integrally extending from the thermally conductive portion of the housing; and further wherein the protruding heat sink portion is configured to facilitate thermal coupling with the light emitting diode and serve as a heat sink for the light emitting diode.

Still another described aspect provides a method of dissipating heat from a high power light emitting diode of a power tool, the method comprising: providing a power tool including: a high power light emitting diode; and a metallic housing including a protruding heat sink portion integrally extending from the metallic housing; wherein the protruding heat sink portion is configured to thermally couple with the light emitting diode; thermally coupling the light emitting diode with the protruding heat sink portion of the metallic housing of the power tool; and dissipating heat from the light emitting diode through the protruding heat sink portion, when the light emitting diode is powered on to emit light.

BRIEF DESCRIPTION OF THE DRAWINGS

The described aspects are best understood from the following detailed description when read in connection with the accompanying drawings. Included in the drawings are the following figures.

DETAILED DESCRIPTION

An LED's photometric output increases proportionally with the current, as long as junction temperature is maintained at permissible levels. An LED may characteristically show variable photometric output with a change in junction temperature. Elevated temperatures may also lead to accelerated LED degradation. Thus, it may be desirable to maintain and control the junction temperature.

Figure 1:
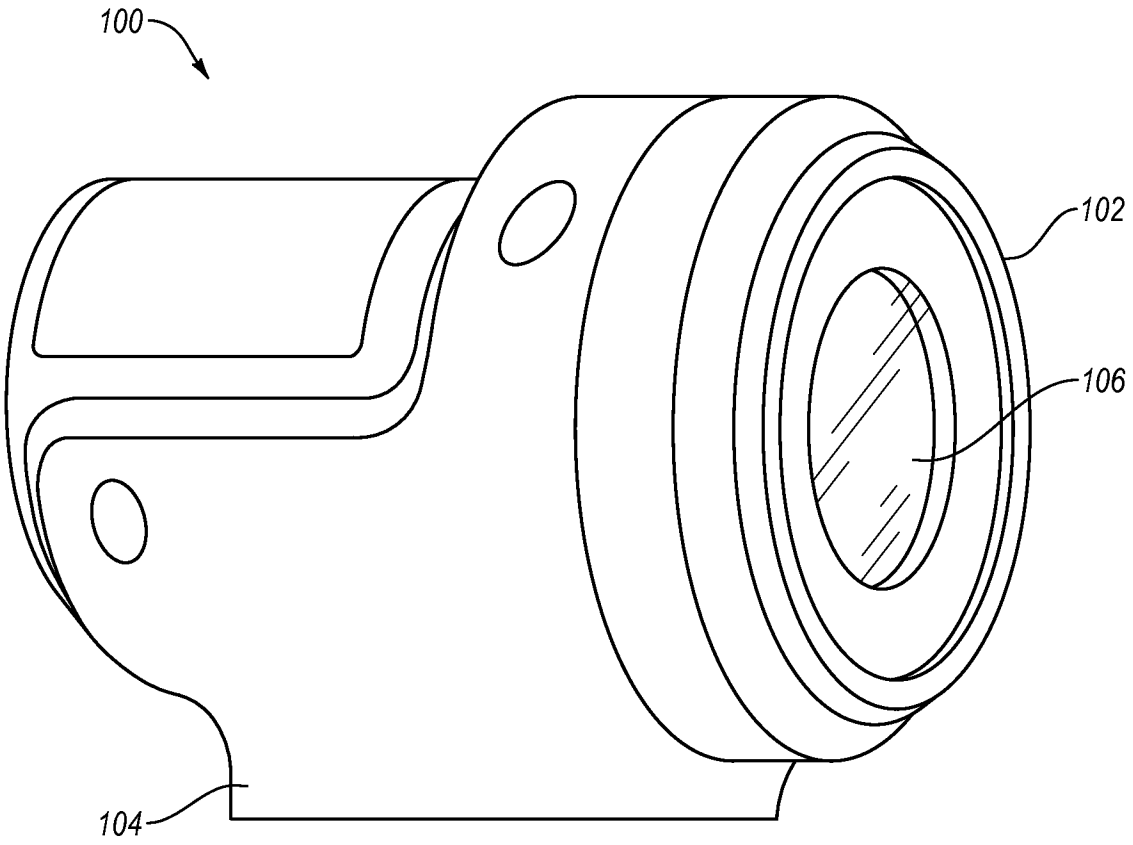
Fig. 1 Prior Art
FIG. 1 is a perspective view of an embodiment of a conventional light emitting apparatus.

Referring to FIG. 1, a conventional LED housing 100 which houses a LED (not shown) in alignment with a lens 106 is depicted. The illustrated LED housing 100 includes first and second housing components 102 and 104. The LED is mounted inside of the LED housing 100 on an internal heat sink (not shown) that is thermally connected to an outer portion of the housing 100. The heat sink may be a portion of the LED housing 100. Furthermore, the heat sink may include a printed circuit board (PCB). The included PCB may be a metal core PCB that facilitates effective heat conduction and dissipation. The outer portion of the LIED housing 100 to which the internal heat sink is thermally connected can be made of a material which also transfers heat, such that the outer portion of the LED housing 100 provides a heat dissipating outer surface exposed to atmosphere.

The outer portion of the LED housing 100 to which the internal heat sink is thermally connected may, for example, be a finished Aluminum surface as a part of LED housing 100. Aluminum includes properties (i.e. strong and light) that provide for a design that dissipates heat for controlling the temperatures of the LED. It is contemplated that one or both housing components 102 and 104 may include the portion of the heat sink.

In this way, the LED housing 100, including the first and second housing components 102 and 104, can transfer heat from the LED junction to an internal heat sink portion and from the internal portion of the heat sink to an outer heat dissipating surface area of LED housing 100. The outer portion of the LED housing 100 may be exposed to atmosphere and may result in increased heat dissipation through radiation and/or convection. In other words, the LED housing 100 may be configured to dissipate heat to surrounding atmosphere via radiative and/or convective heat transfer. Yet, it may be beneficial to adapt housing 100 to embodiments of power tools to be described herein, wherein heat may also be dissipated through conduction.

Figure 2:
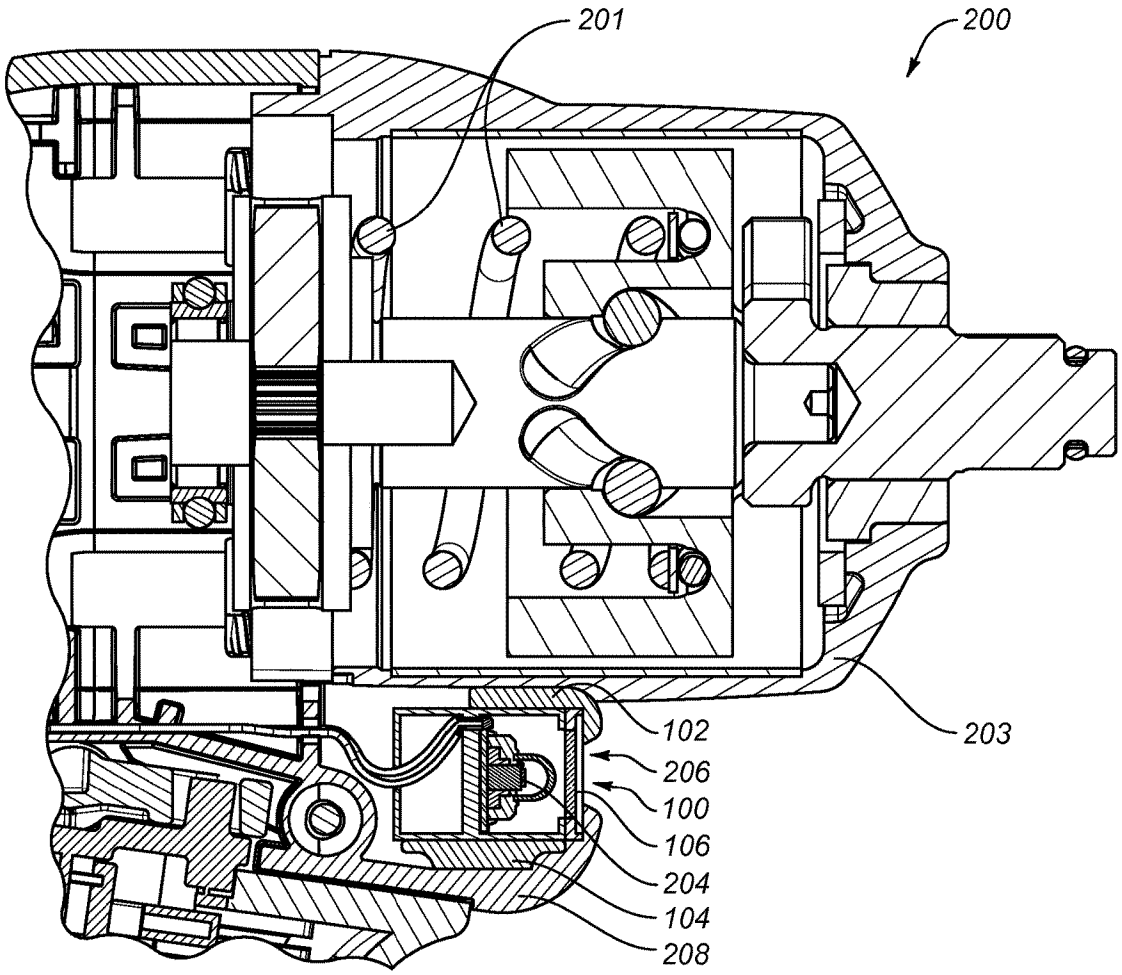
FIG. 2 is a cross-section view of an embodiment of a power tool including an embodiment of a light emitting diode, the light emitting diode having a housing for dissipating heat according to described embodiments.

With further reference to the drawings, FIG. 2 depicts a cross-section view of an embodiment of a power tool 200 that advantageously incorporates the LED housing 100. The power tool 200 may be, for example, but not limited thereto, a battery-powered impact wrench, a handheld power drill, a ratchet driver, or other similar tool, wherein the power tool 200 includes an embodiment of a Light Emitting Diode (LED) 204. The LED 204 and corresponding LED housing 100 may be mounted within the power tool 200. While the power tool 200 is depicted, for exemplary purposes, as an impact wrench, it should be appreciated that the power tool 200 may also comprise, for example, a direct drive or right-angle version of a handheld hammer drill, ratchet driver or drill driver, as well as other similar handheld tools and the like, wherein the handheld tools may be cordless and battery-powered, may be powered via a power cord, or may be pneumatically or hydraulically driven while also possibly including a complimentary battery power-source to power the LED 204. The LED 204 of power tool 200 may be a high power LED requiring efficient heat dissipation in order to maintain and control the junction temperature and avoid accelerated LED degradation.

With further reference to FIG. 2, the LED housing 100 having the LED 204 therein may be mounted within the power tool 200 so that the first and second housing components 102 and 104 of the housing 100 may be thermally coupled, or otherwise mounted to portions of the power tool 200. For example, first housing component 102 may be mounted so as to contact or otherwise reside against a section of a thermally conductive portion of the power tool housing 203. The thermally conductive portion of the power tool housing 203 may house a movable component 201, such as a spring, direct drive gear train, and/or other related direct drive mechanisms, of the power tool. For example, thermally conductive portions of the power tool housing 203 may be portions of a hammer case of an impact wrench, wherein the hammer case, inter alia, houses a spring and other movable components effectuating the hammer function of the impact wrench. Other movable components 201 of other power tool embodiments, such as, movable springs, rods, gears, motors, etc., and the like, of a drill or drive tool or other like power tool components, should be appreciated.

A thermally conductive portion of the power tool housing 203 may be metallic. For example, the hammer case of an impact wrench, or other similar tool such as a hammer drill, may be formed of aluminum or other metals typically having good thermal conductance properties. The thermally conductive portion of the power tool housing 203, or at least a significant portion thereof, may be exposed to the atmosphere.

Moreover, second LED housing component 104 may be mounted so as to contact or otherwise reside against a section of a molded portion of the power tool housing 208. The molded portion of the power tool housing 208 may be formed of injection-molded plastic, may be formed of die-cast or machined metal, such as aluminum, or may be formed of some combination thereof. In this manner, heat from the LED 204 dissipates through the first and second housing components 102 and 104 of the LED housing 100 and into the thermally conductive portion of the power tool housing 203 and the molded portion of the power tool housing 208. As such, the power tool housing 203 and the molded portion of the power tool housing 208 may function as heat sinks for dissipation of heat generated by the LED 204.

Figure 3:
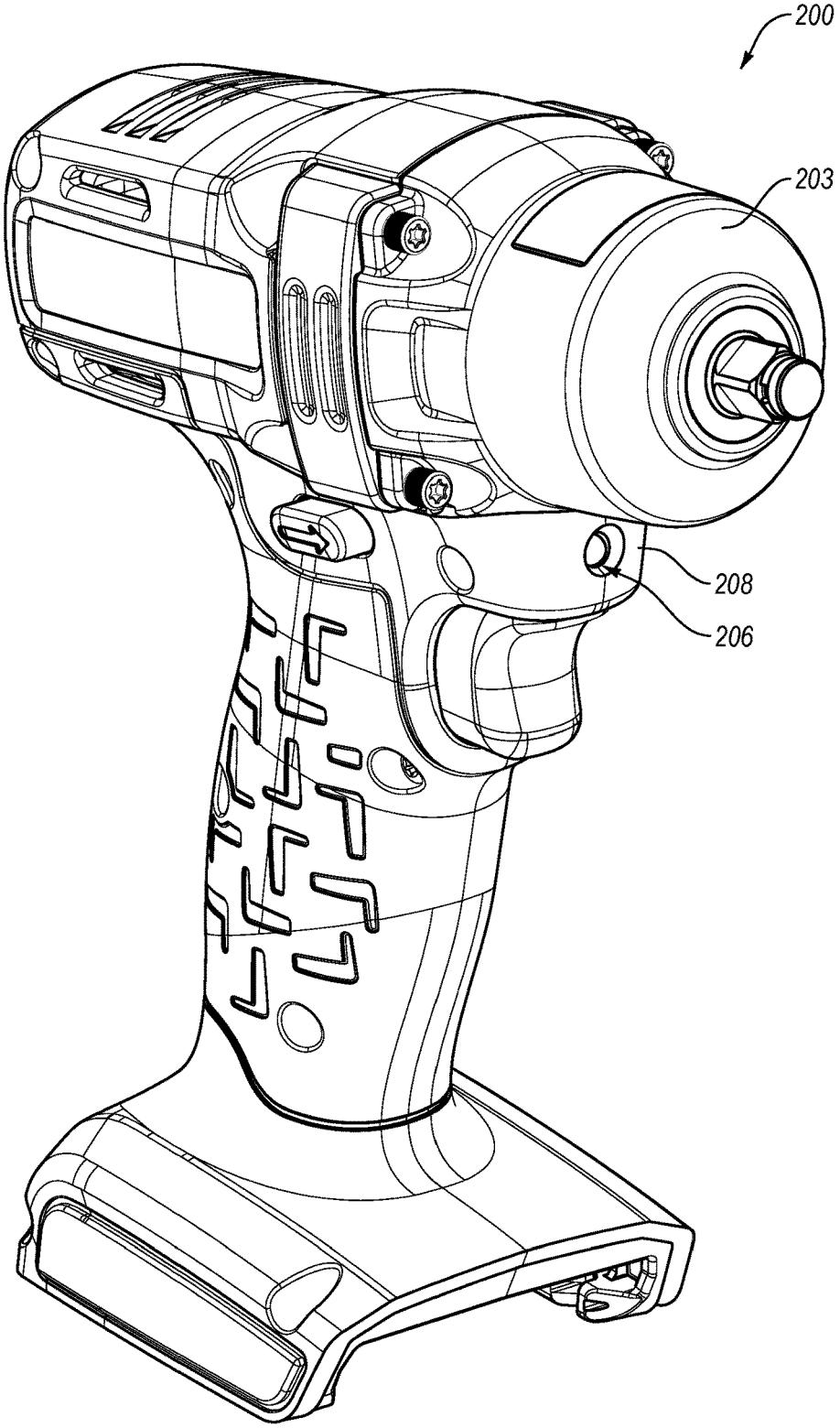
FIG. 3 is a perspective view of the power tool of FIG. 2.

In addition, with the LED housing 100 mounted within the power tool 200, the LED 204 may operate within the LED housing 100 having s lens 106 that may permit the projection of light emanating from the LED 204, through the lens 106, as well as through an LED opening 206 of the molded portion of the power tool housing 208. Thus, light from the LED 204 may be projected toward the equipment or the work surface upon which the power tool 200 may be operating, as shown, in some respects, in FIG. 3, which depicts a perspective view of the power tool 200 of FIG. 2.

Figure 4:
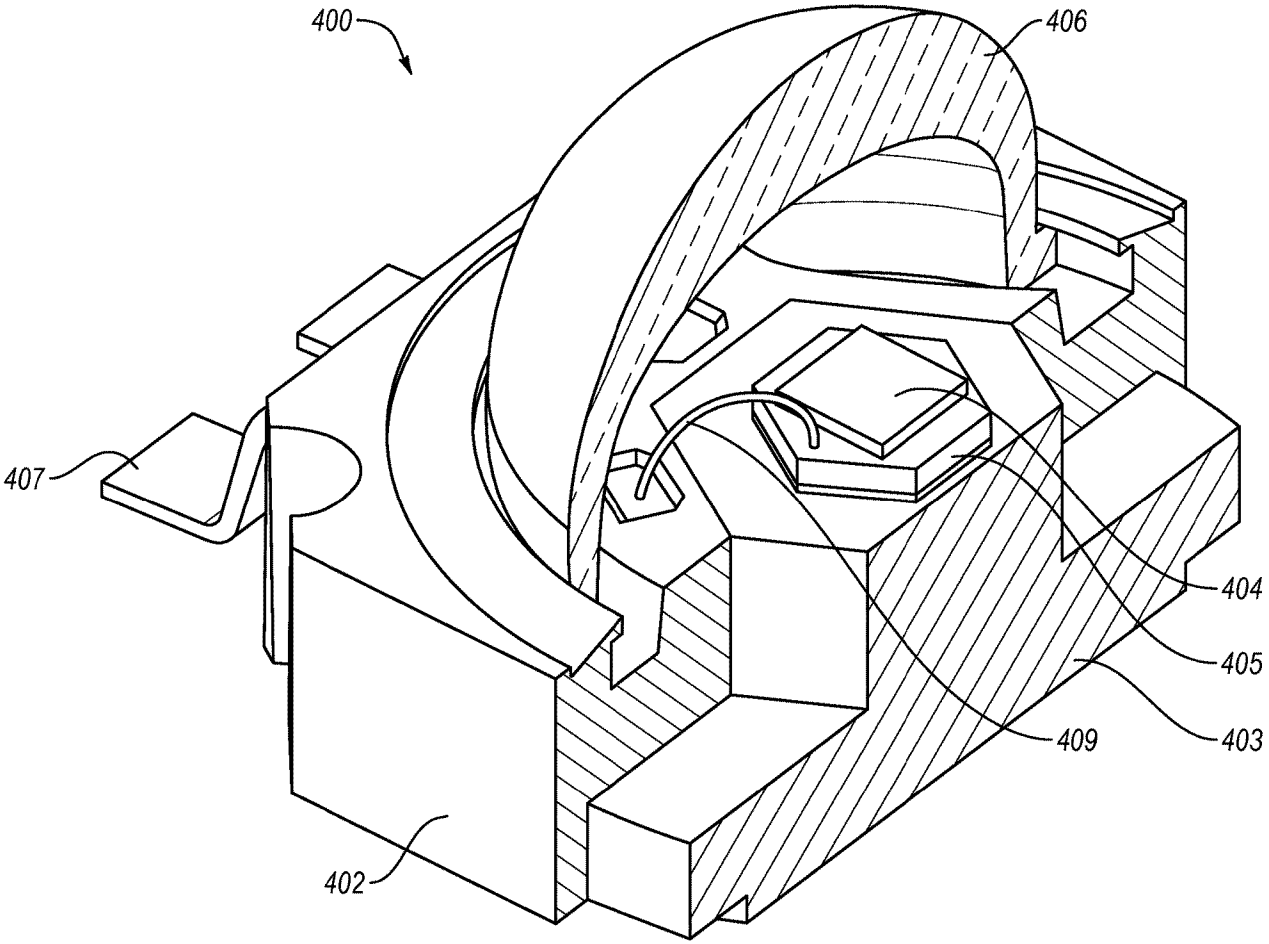
Fig. 4 Prior Art
FIG. 4 is a cut-away cross-section view of an embodiment of a light emitting diode.

Referring further to the drawings, FIG. 4 depicts a cut-away cross-section view of an embodiment of a common light emitting diode 400. The light emitting diode (LED) 400 may be a high power LED. An LED chip 404, of the LED 400, may be positioned upon a silicon submount 405. The LED chip 404 and the silicon submount 405 may be physically and thermally coupled to a thermal heat sink portion 403 of the LED 400. In addition, a lens mount portion 402 may help retain a lens 406 in place over the LED chip 404. Electrical power may be connected to the LED 400 via cathode leads 407, and a bond wire 409 may serve as a further conduit for electrical power needed to foster light emission by the LED 400. The LED 400 is configured, inter alia, for heat dissipation via thermal conduction from its thermal heat sink 403 to another thermally conductive component and then eventually on to the atmosphere or to additional thermally conductive components. The LED 400 can be provided without a housing.

Because effective heat dissipation is often critical for efficient and durable LED use, power tools incorporating LEDs, especially power tools that incorporate high power LEDs, often utilize separate heat sink components to help manage heat generation, transfer, and/or dissipation. For example, LED housing 100 helps dissipate heat from LED 204. Furthermore, other additional and distinct heat sink components may be mounted in conjunction with LEDs or printed circuit boards (PCBs) associated with LEDs inside power tool housings to help manage heat dissipation. However, in embodiments of power tools, it may be advantageous to eliminate the incorporation of such separate heat sink components.

Figure 5:
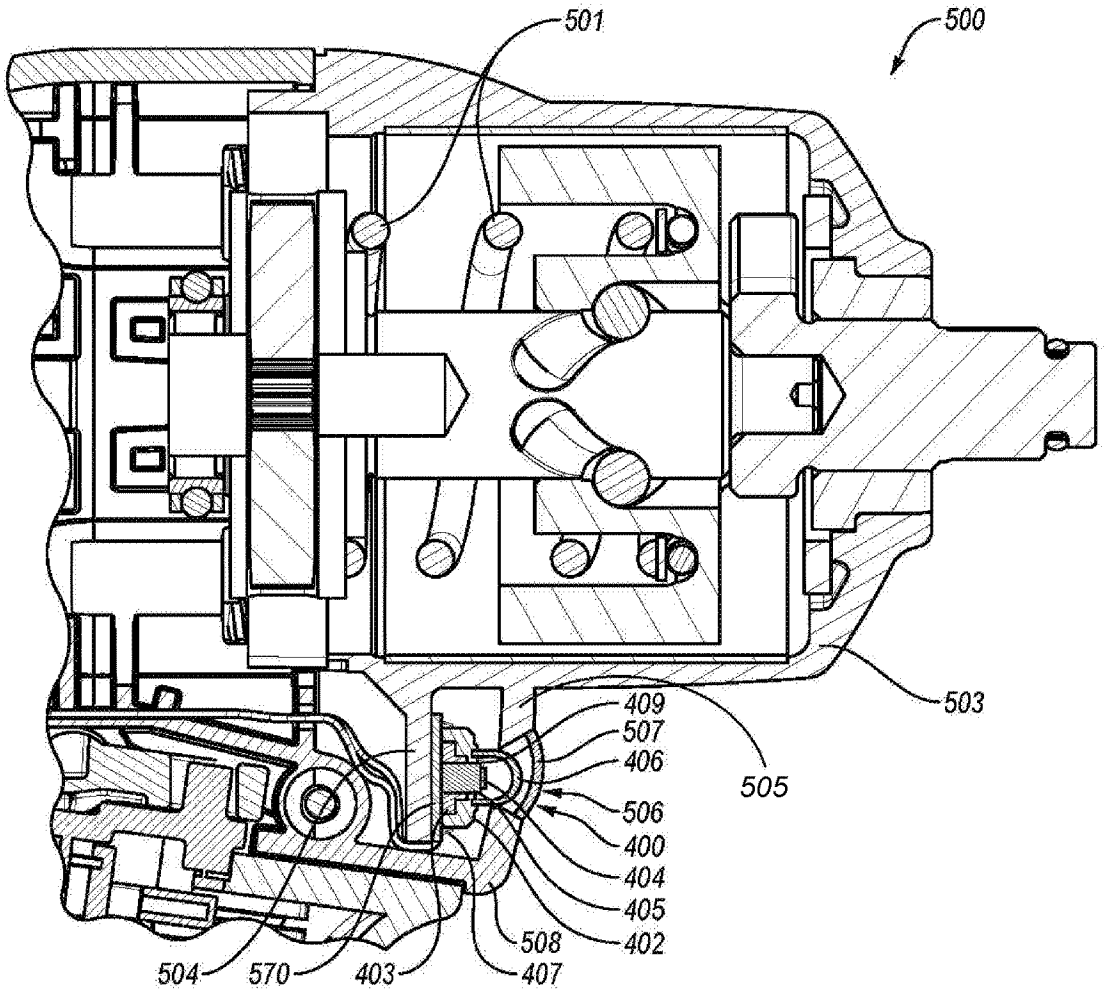
FIG. 5 is a cross-section view of another embodiment of a power tool including an embodiment of a light emitting diode configured to dissipate heat to an embodiment of an integral heat sink portion of the power tool housing according to described embodiments.

FIG. 5 depicts a cross-section view of an exemplary embodiment of a power tool 500 including a light source and a thermally conductive housing 503 having an integral heat sink portion 504. In the illustrated embodiment, the light source is a light emitting diode (LED) 400 configured to dissipate heat to the integral heat sink portion 504 of the power tool housing 503 according to described embodiments.

The thermally conductive portion of the power tool housing 503 may house a movable component 501, such as a spring, of the power tool 500. For example, thermally conductive portions of the power tool housing 503 may be portions of a hammer case of an impact wrench, or a hammer drill or other like tool, wherein the hammer case, inter alia, houses a spring, a direct drive gear train, and/or other related direct drive mechanisms, and other movable components, such as movable springs, rods, gears, motors, etc, and the like, which movable components may help facilitate operation of the power tool 500.

The thermally conductive portions of power tool housing 503, such as a hammer case, may include the integral heat sink portion 504. In one embodiment the heat sink portion 504 may be configured to operate with and conduct heat way from an LED, such as LED 400. The integral heat sink portion 504 may extend or otherwise protrude from the thermally conductive portions of the power tool housing 503 and may be configured to facilitate thermal coupling with an LED 400 thereby serving as a heat sink for the LED 400. The integral heat sink portion 504 may be a unitary member of the housing 503. As such, the integral heat sink portion 504 may be manufactured or formed concurrently with the housing 503. The inclusion of the protruding heat sink portion 504 integrally extending from the thermally conductive portion of the power tool housing 503 can eliminate the need for a separate heat sink component and may facilitate efficient heat transfer and dissipation. As such, an LED, like a high power LED 400, can be configured and mounted within power tool 500 in such a way that heat is dissipated through the heat sink portion 504, thereby reducing the bulk, weight, and/or cost of extra component(s) that may be associated with a separate LED housing heat sink componentry, such as first and second housing components 102 and 104 of LED housing 100, or such as some other separate heat sink component(s). Moreover, such a tool configuration can take advantage of the thermal conductive properties of common power tool housing portions, such as a hammer case, which portions are often made of made of aluminum. The integral portion 504 of the thermally conductive portion of the power tool housing 503 may therefore serve as a heat sink for the heat generated by the light emitting diode 400, when the light emitting diode 400 is thermally coupled to the integral heat sink portion 504 of the housing 503.

As further depicted in FIG. 5, a thermal heat sink portion 403 of LED 400 may be configured for operation with a printed circuit board (PCB) 570. The PCB 570 may be functionally and/or structurally a component of the LED 400. Thus, embodiments of an LED 400 may operationally include the PCB 570. Heat dissipation may efficiently travel from the LED chip 404 and silicon submount 405 through the thermal heat sink portion 403 as well as through the PCB 570 and into the integral heat sink portion 504 of the thermally conductive power tool housing 503 of power tool 500. Embodiments may be provided without a PCB 570. Moreover, embodiments may be provided having a plurality of LED's 400, wherein the plurality of LED's may be operable with one PCB 570 or a plurality of PCB's 570. Dissipation of heat associated with the operation of an LED 400 can capitalize on the desirable thermal conductivity of integral heat sink portion 504 directly integrated with the thermally conductive power tool housing 503 (often an aluminum hammer case component) of power tool 500, rather than relying upon potentially less thermally conductive properties associated with dissipation through molded power tool housing portion 508, which is often comprised of injection molded plastic.

Embodiments of the housing 503, having the integral heat sink portion 504 as an integral portion thereof, may comprise the integral heat sink portion 504 extending substantially orthogonally, and in some cases obliquely, from the housing 503 for a given length. The length of the integral heat sink portion 504 may be at least twice as long as a width of the integral heat sink portion 504. Alternatively, the length of the integral heat sink portion 504 may be substantially three times as long as a width of the integral heat sink portion 504. Further in the alternative, the length of the integral heat sink portion 504 may be more than four times as long as a width of the integral heat sink portion 504. Embodiments of the housing 503, may also comprise a second integral portion 505 configured generally parallel to the (first) integral portion 504. The second integral portion 505 may have a length dimension extending away from the housing 503 that is less than the length of the (first) integral portion 504 and may also have a distal portion orthogonally away from the axis of the movable drive component of the power tool 500.

The length of the integral heat sink portion 504 may define a first surface against which the PCB 570 and/or a separate LED 400 may be functionally coupled, or otherwise operatively positioned. As an illustrative example, an entire length of the PCB 570, and in particular the rear surface of the PCB 570 that faces away from the LED 400, may be configured, or otherwise positioned, substantially flush up against the surface of the integral heat sink portion 504 to maximize heat transfer away from the thermal heat sink portion 403, through the PCB 570, and into the integral heat sink portion 504. The PCB 570 may be a metal core board and a thermal compound may be utilized between these components to accelerate or foster the heat dissipation away from the LED chip 404 and into the integral heat sink portion 504. Further, the first surface may be configured to oppose the LED opening 506, such that a cavity is defined there between. The cavity may be configured to house components of the LED 400, including but not limited to the LED chip 404, the silicon submount 405, and the thermal heat sink portion 403.

The length of the integral heat sink portion 504 may define a second surface that opposes the first surface. The second surface may be configured to be exposed to, or otherwise face, a void within an interior region of the power tool 500. As such, the second surface may be configured to exchange, transfer, or otherwise dissipate heat by radiation and/or convection to the void or other surrounding surfaces in communication with the void.

Figure 6:
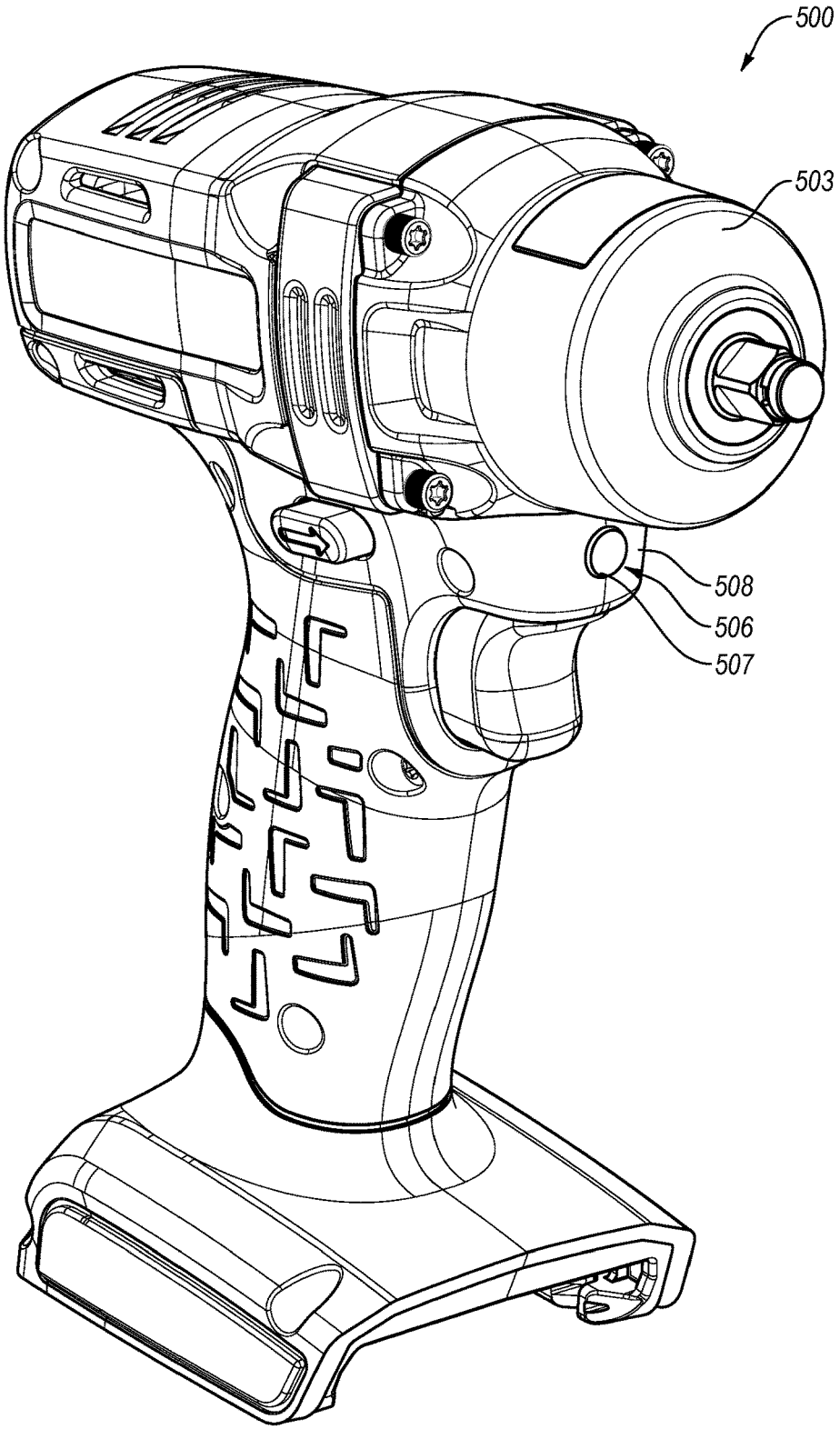
FIG. 6 is a perspective view of the power tool of FIG. 5.

The cathode leads 407 and bond wire 409 can provide power necessary for the LED 400 to emanate light. An optional clear or translucent LED cover 507 can be fashioned over the LED opening 506 of the molded power tool housing portion 508 of power tool 500. Light emanating through the lens 406 retained by the lens mount portion 402 of LED 400, can be directed toward the equipment or the work surface upon which the power tool 500 may be operating, as shown, in some respects, in FIG. 6, which depicts a perspective view of the power tool 500 of FIG. 5.

Figure 7:
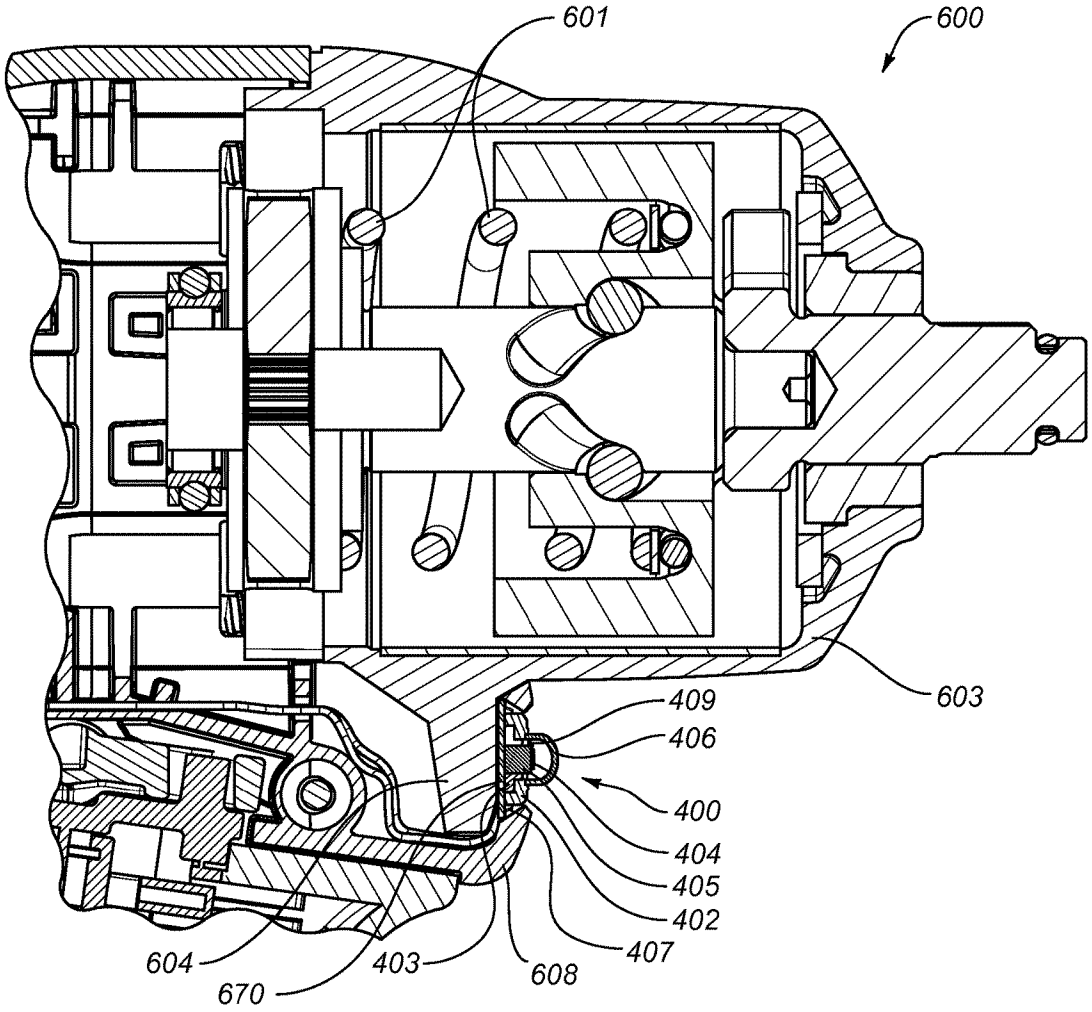
FIG. 7 is a cross-section view of still another embodiment of a power tool including an embodiment of a light emitting diode configured to dissipate heat to an embodiment of an integral heat sink portion of the power tool housing according to described embodiments.

With further reference to the drawings, FIG. 7 depicts a cross-section view of still another exemplary embodiment of a power tool 600 including a light source and a thermally conductive housing 603 having an integral heat sink portion 604. In the illustrated embodiment, the light source is a light emitting diode (LED) 400 configured to dissipate heat to the integral heat sink portion 604 of the power tool housing 603. The thermally conductive portion of the power tool housing 603 may be a portion of a hammer case of an impact wrench, or a hammer drill or other like tool, wherein the hammer case, inter alia, may house a movable component 601, such as a spring, a direct drive gear train, and/or other related direct drive mechanism, or other impact mechanism, a rod, gear, a motor, or other drive mechanism, etc, and/or the like, of the power tool 600, which movable components may help facilitate operation of the power tool 600.

The thermally conductive portions of power tool housing 603, such as a hammer case, may include the integral heat sink portion 604 configured to thermally couple with and conduct heat way from an LED, such as LED 400. The integral heat sink portion 604 may be a unitary member of the housing 603 and may be manufactured or formed concurrently with the housing 603. An LED 400, or a plurality of LED's 400, may be mounted directly to the integral heat sink portion 604 of the power tool housing 603, thereby eliminating the need for a separate heat sink component while facilitating efficient heat transfer and dissipation. As such, an LED, like a high power LED 400, can be configured and mounted directly upon the thermally conductive portion of the housing 603 of power tool 600 in such a way that heat is dissipated through the heat sink portion 604, thereby reducing the bulk, weight, and/or cost of extra component(s) that may be associated with a separate LED housing heat sink componentry, such as first and second housing components 102 and 104 of LED housing 100, or such as some other separate heat sink component(s). Moreover, such a tool configuration can take advantage of the thermal conductive properties of common power tool housing portions, such as a hammer case, which portions are often made of made of aluminum. The integral portion 604 of the thermally conductive portion of the power tool housing 603 may therefore serve as a heat sink for the heat generated by the light emitting diode 400, when the light emitting diode 400 (with or without a complimentary PCB 670) is thermally coupled directly to the housing 603 of the power tool 600.

Shown further in FIG. 7, a thermal heat sink portion 403 of LED 400 may be configured for operation with a complimentary printed circuit board (PCB) 670. The PCB 670 may be functionally and/or structurally a component of the LED 400. Thus, embodiments of an LED 400 may operationally include the PCB 670. Heat dissipation may efficiently travel from the LED chip 404 and silicon submount 405 through the thermal heat sink portion 403 as well as through the PCB 670 and directly into the integral heat sink portion 604 of the thermally conductive power tool housing 603 of power tool 600. Embodiments may be provided without a PCB 670. Embodiments may be provided without a PCB 670. Moreover, embodiments may be provided having a plurality of LED's 400, wherein the plurality of LED's may be operable with one PCB 670 or a plurality of PCB's 670. Dissipation of heat associated with the operation of LED 400 can capitalize on the desirable thermal conductivity of integral heat sink portion 604 directly integrated with the thermally conductive power tool housing 603 (such as heat conduction directly through the aluminum hammer case) of power tool 600, rather than relying upon potentially less thermally conductive properties associated with dissipation through molded power tool housing portion 608, which is often comprised of injection molded plastic.

Figure 8:
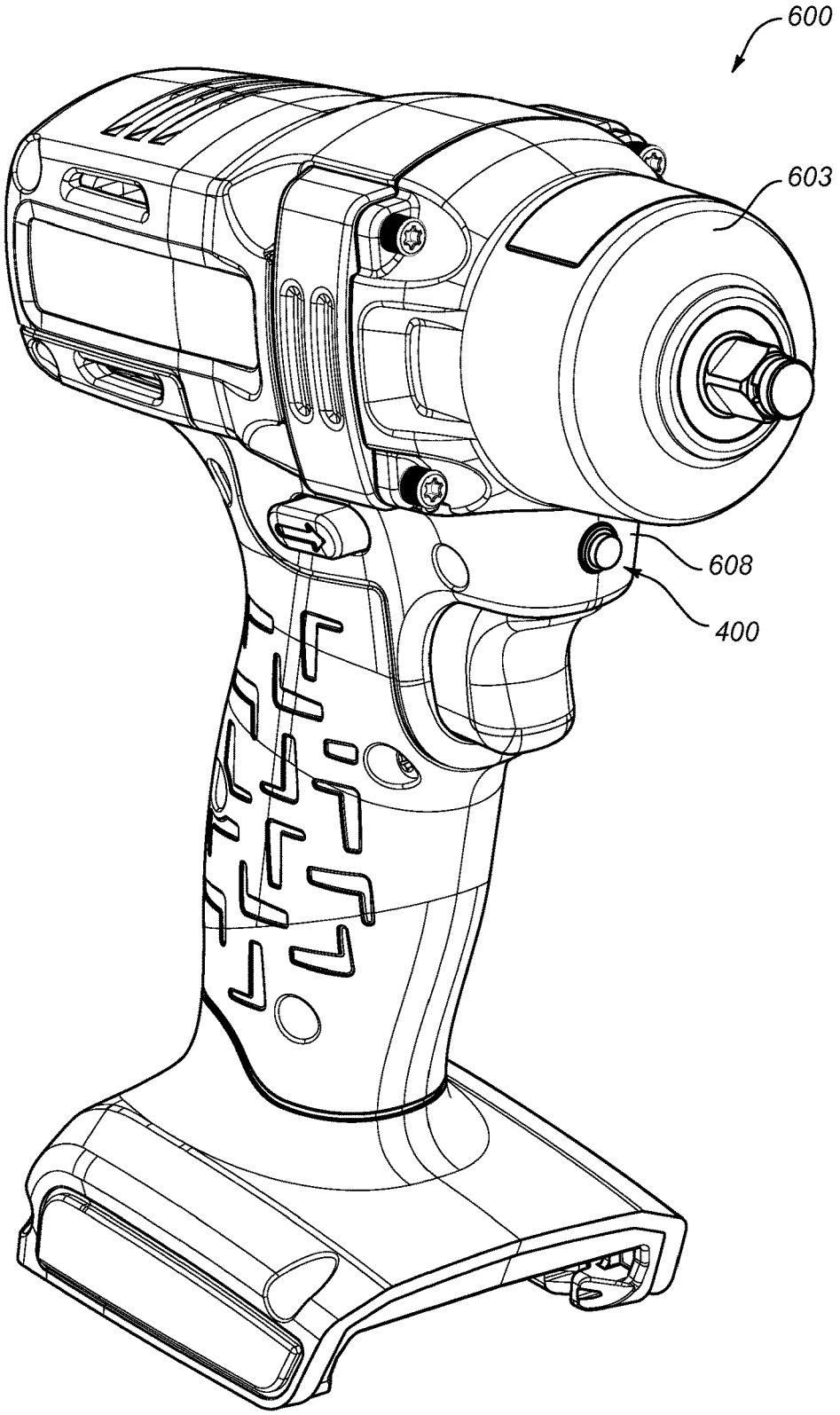
FIG. 8 is a perspective view of the power tool of FIG. 7.

The cathode leads 407 and bond wire 409 can provide power necessary for the LED 400 to emanate light. Light emanating through the lens 406 retained by the lens mount portion 402 of LED 400, can be directed toward the equipment or the work surface upon which the power tool 600 may be operating, as shown, in some respects, in FIG. 8, which depicts a perspective view of the power tool 600 of FIG. 7.

With reference to FIGS. 1-8, a method of dissipating heat from a high power LED 400 of a power tool, such as power tool embodiments 500 or 600, is described. A first methodological step may include the provision of providing a power tool 500/600. The power tool 500/600 may include a high power LED 400. The power tool 500/600 may also include a metallic housing 503/603 including an integral heat sink portion 504/604 configured to thermally couple with the LED 400. A further methodological step may include thermally coupling the LED 400 with the integral heat sink portion 504/604 of the metallic housing 503/603 of the power tool 500/600. Additionally another methodological step may include dissipating heat from the LED 400 through the integral heat sink portion 504/604, when the LED 400 is powered on to emit light.

Although various aspects are illustrated and described herein with reference to specific embodiments, the aspects, in whole and in part, are not intended to be limited to the details shown. Rather, various modifications may be made in the details within the scope and range of equivalents of the claims and without departing from the invention.

What is claimed is:

1. A power tool comprising:

a light source comprising an LED having a thermally conductive heat sink; and a metallic housing that houses a movable drive component of the power ool, the movable drive component having an axis and the power tool having a front end and a back end, the metallic housing including a first integral portion thereof configured for thermally coupling directly with the thermally conductive heat sink of the light source;

said first integral portion configured to present a first surface generally orthogonal to the axis of the movable drive component and having a first length dimension extending away from the metallic housing;

the metallic housing also including a second integral portion thereof configured generally parallel to said first integral portion and having a second length dimension extending away from the metallic housing that is less than the first length dimension and the second integral portion having a distal portion orthogonally away from the axis;

wherein the LED is coupled to the first surface of the first integral portion;

a second housing portion connected to the power tool to cover the first integral portion and configured such that LED opening is presented between the distal portion of the second integral position and the second housing portion and such that an LED cavity is presented between the first integral portion, the second integral portion and the second housing portion; and wherein the light source is thermally coupled directly to the first integral portion of the metallic housing.

2. The power tool of claim 1, wherein at least a portion of the first integral portion is a thermally conductive material.

3. The power tool of claim 2, wherein the light source is operatively mounted to the length of the first metallic integral portion.

4. The power tool of claim 1, wherein the first integral portion extends a length at least twice as long as a width of the first integral portion.

5. The power tool of claim 4, wherein the light emitting diode is operatively mounted to the first surface of the first integral portion.

6. The power tool of claim 1, further comprising a printed circuit board, wherein the printed circuit board is mounted to the first integral portion and the light source is mounted to the printed circuit board.

7. The power tool of claim 6, wherein substantially an entire rear surface of the printed circuit board is mounted to the integral portion.

8. The power tool of claim 1, wherein the light source is a solid state device.

9. The power tool of claim 1, wherein the moveable component is a direct drive mechanism.

10. The method of claim 1, wherein a plurality of light emitting diodes are operatively mounted to the first integral portion.

11. The power tool of claim 1 wherein the second housing portion comprises a left and a right generally mirror portion.

* * * * *